United States Patent [19]

Bosshart et al.

[11] Patent Number: 4,554,752

[45] Date of Patent: Nov. 26, 1985

[54] HEATED CYLINDER IRONER UTILIZING A FLEXIBLE IRONING BED

[75] Inventors: John Bosshart, Coral Springs; William W. Allen, Plantation, both of Fla.

[73] Assignee: Jensen Corporation, Lauderdale, Fla.

[21] Appl. No.: 727,345

[22] Filed: Apr. 25, 1985

[51] Int. Cl.[4] ..... D06F 65/06

[52] U.S. Cl. ..... 38/61; 38/47; 38/56; 38/68

[58] Field of Search ..... 38/8, 56, 18, 27, 28, 38/47, 50, 64, 68, 61; 69/41, 42, 43; 100/155; 68/5 D; 101/219, 232, 25; 26/20, 28, 32

[56] References Cited

U.S. PATENT DOCUMENTS

| | | | |
|---|---|---|---|
| 1,151,826 | 8/1915 | Ruhe | 69/41 |
| 2,139,544 | 12/1938 | Fleming | 38/68 X |
| 2,538,094 | 1/1951 | Goodman, Jr. | 38/9 |
| 3,587,258 | 6/1971 | Plechac | 38/61 X |
| 3,681,865 | 8/1972 | McMillan | 38/56 |
| 3,788,106 | 1/1974 | True | 38/56 X |
| 4,432,149 | 2/1984 | Banks | 38/55 |
| 4,434,566 | 3/1984 | Krauss et al. | 38/8 |
| 4,488,365 | 12/1984 | Hord et al. | 38/47 |

*Primary Examiner*—Werner H. Schroeder
*Assistant Examiner*—Andrew M. Falik
*Attorney, Agent, or Firm*—Oltman and Flynn

[57] ABSTRACT

A heated revolving ironing cylinder is affixed with a flexible ironing bed drawn taut against the polished revolving cylinder surface functioning to efficiently iron and dry laundry work pieces in a single pass through the ironer. The ironer is comprised of a feed conveyor system delivering laundry work pieces to the top of the revolving ironing cylinder. The flexible ironing bed features holes and anti-friction and anti-static materials to provide a dry, highly polished, static-free laundry work piece. Further ironing efficiency is gained by reduced roller maintenance by means of a roller and air cylinder cooling system.

7 Claims, 5 Drawing Figures

HEATED CYLINDER IRONER UTILIZING A FLEXIBLE IRONING BED

BACKGROUND OF THE INVENTION

Various types of revolving cylinder ironing and drying machines have been devised for over a hundred years. All have attempted to both iron and dry laundry work pieces at high speed with minimal breakdown. Unequal shine imparted to the two sides of the laundry work piece is another historic problem. U.S. Pat. No. 2,538,094 issued in 1951 to Goodman improved a heated cylinder with a flexible ironing bed design. The basic design used a continuous blanket as the ironing bed. Goodman added an ironing roller to further iron the side of the laundry work piece in contact with the flexible ironing bed.

Several inventions utilize multiple revolving cylinders pushing against a fixed padded ironing bed. These types of systems require careful operator attention to avoid jamming. Additional problems stem from mechanical breakdown of the numerous moving parts. Thus constant efforts have been forthcoming to produce a simple easy to operate ironer that imparts an equal shine to both sides of the laundry work piece.

Modern research has created new heat resistant materials capable of serving as flexible ironing beds when drawn taut against a heated revolving cylinder. This approach allows a single pass of the laundry work piece between the heated revolving cylinder and the fixed taut flexible ironing bed to produce an excellent two sided shine. A high temperature polished revolving cylinder coupled with a plurality of holes in the flexible ironing bed properly dries the laundry work piece in one pass.

SUMMARY OF THE INVENTION

The primary object of the present invention is to provide a low maintenance one pass ironer thereby reducing the operating costs of an automated laundry. The means utilized to achieve this object include:

First, a unique flexible ironing bed is drawn taut against a conventional heated revolving cylinder.

Second, a conveyor is used to feed the laundry work pieces to the top of the cylinder into the space between the cylinder and the flexible ironing bed.

Third, unique cylinder bearing and air cylinder cooling means are used including a weight bearing ridge on one or both ends of the revolving cylinder and compressed air blowing on the support bearings and air cylinder.

Other objects of this invention will appear from the following description and appended claims, reference being had to the accompanying drawings forming a part of this specification wherein like reference characters designate corresponding parts in the several views.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Figure 1:
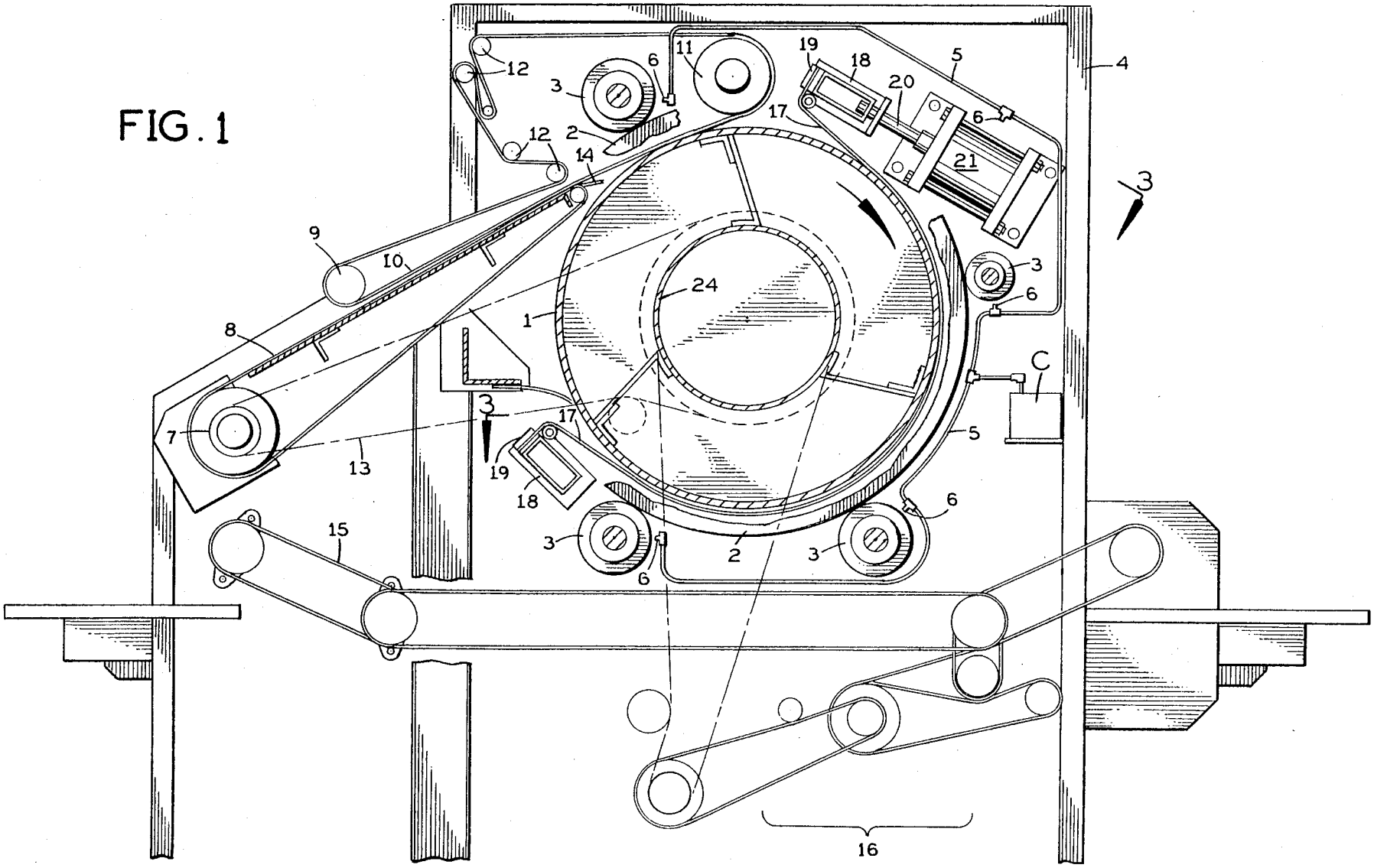
FIG. 1 is a vertical section of the end of the heated revolving cylinder depicting the essential design and placement of the flexible ironing bed, the bearing cooling ridge and the feed conveyor.

FIG. 1 shows a vertical cross section of substantially all the major portions of an ironer and dryer utilizing the present invention. Any suitable heating means (not shown) for the revolving cylinder 1 may be used. The cylinder is comprised of a weight bearing ridge 2 at one end. The ridge 2 supports the rolling weight of cylinder 1 on heavy duty bearings 3. Thus the high temperature of approximately 450° F. of the cylinder 1 surface is not transmitted to the bearings 3. Further cooling of the bearings is obtained by means of a tube 5 mounted close to the bearings 3. The tube 5 contains compressed air which is blown directly on the bearings 3 and power cylinder 21 through air holes 6. The bearings 3 and all other major components are mounted to the frame 4.

Figure 3:
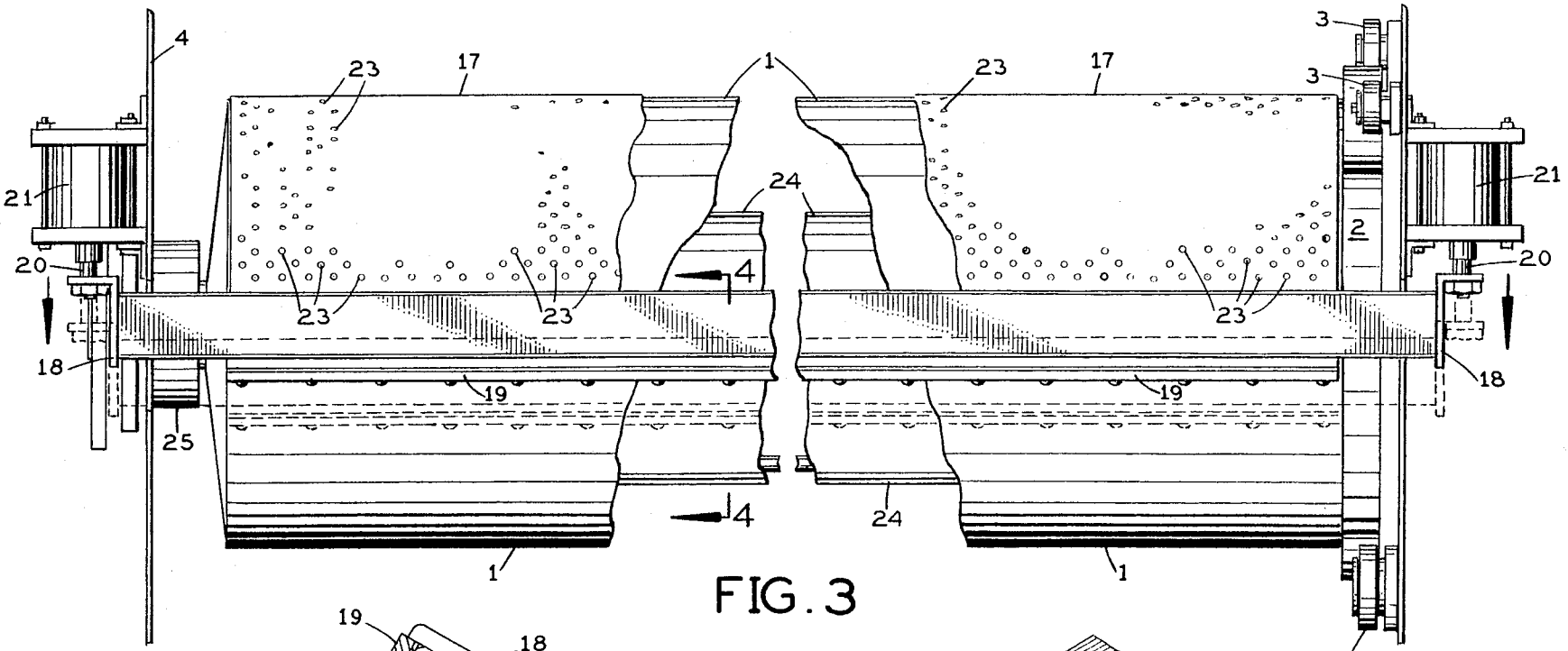
FIG. 3 is a top view of the ironer depicting the flexible ironing bed drawn against the revolving cylinder.

Compressor C supplies the air to air tube 5. The preferred embodiment displayed in FIG. 3 shows the cylinder 1 supported at the end away from a burner (not shown) by an axle and one bearing which is shielded from internal heat by insulation and a heat reflector (not shown).

The flexible ironing bed 17 is anchored close to the cylinder 1 about one third the height of the cylinder 1 and away from the direction of rotation of the cylinder. A metal strip 19 running the length of the cylinder 1 is affixed to each end of the flexible ironing bed 17. This metal strip 19 is affixed to a stationary bracket 18 forming the lower anchor for the flexible ironing bed 17. The upper bracket 18 is affixed to the metal bracket 19 at the upper end of the flexible ironing bed 17. The upper brackets 18 are affixed to the pistons 20 of two power cylinders 21 mounted to frame 4 at each end of the cylinder 1. FIG. 3 provides a top view of the metal strip 19 and power cylinders 21. The power cylinders 21 move the flexible ironing bed 17 in a taut position against the cylinder 1 for ironing when a laundry work piece is sensed on conveyor 8 by a switch activating means (not shown). When no laundry work pieces are on the conveyor or being ironed, the power cylinders move to their relaxed position allowing the flexible ironing bed 17 to brush gently against the cylinder 1 thus minimizing heat friction and maintenance.

A laundry work piece feed conveyor system comprises a chain power means 13 turning a main driving roller 7 which in turn drives a conveyor belt 8 in the direction up the conveyor ramp to the top of the cylinder 1. The conveyor belt 8 forms a continuous loop by means of feed roller 11, spindles 12 and feed roller 9 to create two conveyor surfaces 8 and 10 which pull the laundry work piece up the conveyor. A plurality of transfer fingers 14 ease the laundry work pieces onto the cylinder 1.

The remaining equipment is not claimed as invention but is provided to more fully describe the total operation of the ironer. A motorized conveyor drive system 16 includes a forward and reverse clutch and moves a finished laundry work piece by means of conveyor 15 away from the ironer.

Summarizing the operation of the ironer we have a heated revolving polished cylinder 1 supported by the weight bearing cooling ridges 2 which ride on bearings 3. The bearings and power cylinders 21 are mounted to the frame 4 and cooled by air tube 5. Laundry work pieces are fed up the conveyor belt 8 and activate the power cylinders 21 to pull the flexible ironing bed 17 tight against the cylinder 1. The laundry work pieces are ironed and dried by the heat and friction between the cylinder 1 and flexible ironing bed 17. The ironed laundry work pieces fall onto the conveyor 15 and move away from the ironer.

Figure 2:
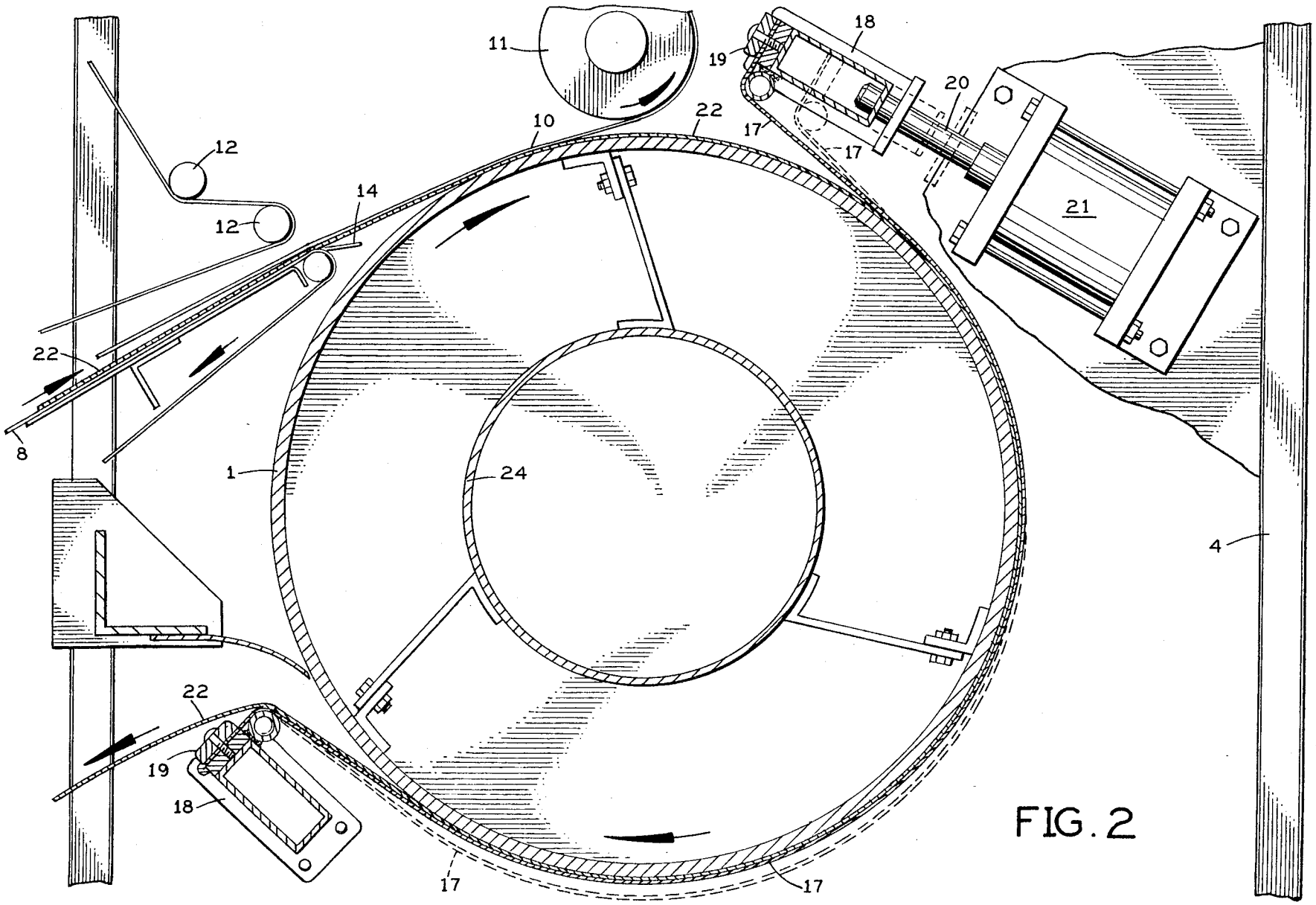
FIG. 2 is a close-up of a similar view depicting the mounting means for the flexible ironing bed.

FIG. 2 shows the flexible ironing bed in both the taut and loose positions (dotted lines). The means used include power cylinders 21, pistons 20, mounting brackets 18 and metal strip 19 affixed to the mounting brackets. A laundry work piece 22 is shown during the ironing process. Conveyor surfaces 10 and 8 move the laundry work piece over transfer fingers 14 onto the top of cylinder 1 where feed roller 11 flattens the laundry work piece onto the hot polished surface of the cylinder 1 whose rotation draws the laundry work piece against the flexible ironing bed 17.

FIG. 3 is a top view of the ironer. The flexible ironing bed is depicted in its taut and slack (dotted lines) positions. The metal strip 19 holds the flexible ironing bed in position over the cylinder 1 by means of brackets 18 which are affixed to power cylinder 21. This is appropriate for use in a gas fired center tube heating means 24 in the cylinder. The raised edge 2 is used at the burner (not shown) end of the cylinder 1. Bearings 3 support the rolling cylinder 1 at the burner end while axle and bearing means 25 support the cylinder 1 end opposite the burner (not shown).

A plurality of holes 23 in the flexible ironing bed 17 allows moisture to escape from the laundry work pieces. This feature greatly facilitates drying the laundry work pieces in one pass through the ironer.

Figure 4:
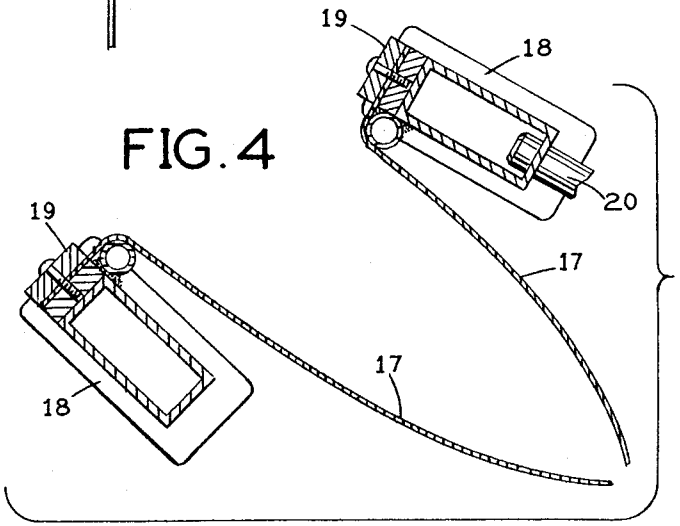
FIG. 4 is a close-up of the mounting means used to secure the flexible ironing bed to its anchors.

FIG. 4 is a close-up of the mounting means of the flexible ironing bed 17. Metal strip 19 is affixed to mounting bracket 18. The lower mounting bracket 18 is anchored in a fixed position. The upper mounting bracket 18 is affixed to a moving piston 20.

Figure 5:
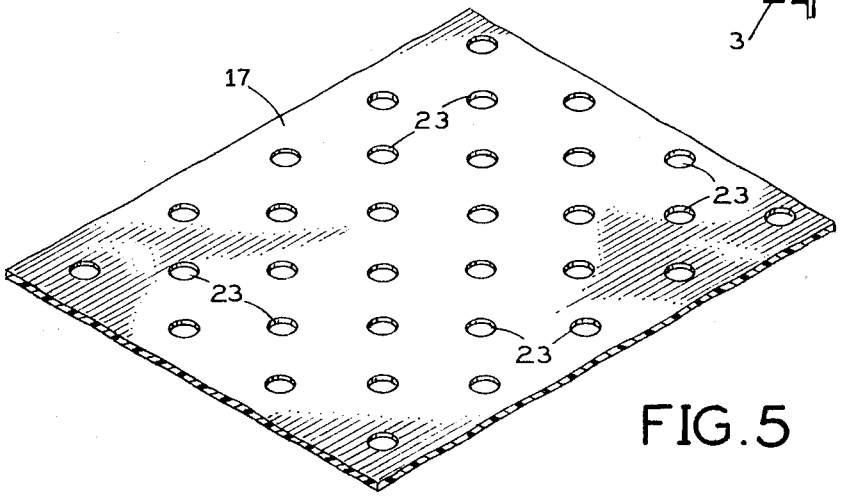
FIG. 5 depicts the plurality of holes in the flexible ironing bed.

FIG. 5 is a close-up of the flexible ironing bed. It is comprised of a heat resistant high tensile strength material impregnated with an anti-friction material and a conductive agent to allow the proper ironing friction without static electrical buildup. The anti-friction material is preferably polytetrafluoroethylene, and the conductive material is preferably graphite.

We claim:

1. A heated revolving ironer and dryer comprising:

a revolving cylinder the outer surface of which provides a heated ironing surface;

a pair of power cylinders;

at least one flexible piece of heat resistant material surrounding a portion of the revolving cylinder forming the flexible ironing bed;

said flexible ironing bed reaching across the ironing surface of the revolving cylinder;

said flexible ironing bed having means to be anchored along the length of the revolving cylinder near the bottom of the revolving cylinder in the direction away from the direction of rotation of the revolving cylinder;

said flexible ironing bed having means along its upper edge to be affixed along the length of the revolving cylinder to the piston arms of said two power cylinders;

said power cylinders affixed adjacent to the opposite ends of the rotating cylinder substantially above the anchored lower edge of the flexible ironing bed such that the flexible ironing bed is drawn taut against the cylinder's ironing surface; and said power cylinders capable of moving said pistons either toward or away from the direction of rotation of the revolving cylinder such that when in position away from the direction of rotation of the revolving cylinder, the flexible ironing bed is drawn taut against the ironing surface of the revolving cylinder thus performing the ironing function as the laundry work pieces are fed between the flexible ironing bed and the rotating cylinder, and when the movable piston is in the position toward the direction of rotation of the rotating cylinder, the flexible ironing bed gently brushes against the ironing surface thus conserving wear and energy when no laundry work pieces are fed into the ironer.

2. A heated revolving ironer and dryer in claim 1 further comprising:

a powered laundry work piece feed conveyor;

said conveyor mounted at an angle so as to feed the laundry work pieces onto the top of the revolving ironer in the direction of rotation of said ironer;

said conveyor driven by a common drive means so as to synchronize the feed speeds with the rotationaal speed of said revolving ironer;

said conveyor further comprising a feed roller on top of the conveyor functioning to flatten the laundry work pieces while travelling up the conveyor surface;

said conveyor further comprising a feed roller in contact with the top of said revolving ironer functioning to feed the laundry work pieces into the space between said revolving ironer and said flexible ironing bed;

said conveyor further comprising a plurality of feed fingers mounted protruding from the top of the conveyor functioning to feed the laundry work pieces from the conveyor to said revolving ironer.

3. A heated revolving ironer in claim 1 further comprising a revolving cylinder bearing cooling system;

said bearing cooling system comprised of two round cylinder weight bearing ridges affixed on the outermost roller surfaces;

said weight bearing ridges substantially flat and polished;

said weight bearing ridges functioning to support the weight of said revolving cylinder by means of a plurality of roller bearings which are mounted to the frame of said ironer;

said bearings spaced so as to bear the weight of the revolving cylinder and prevent said cylinder from moving in any direction other than rotationally;

said bearings and power cylinders directly cooled by forced air supplied by means of a tube mounted in close proximity to all said bearings;

said bearings further cooled by the dissipation of said roller surface heat through the weight bearing ridges.

4. A heated revolving ironer in claim 1 further comprising a revolving cylinder bearing cooling system;

said bearing and power cylinders cooling system appropriate for use with a gas fired center tube cylinder heating means;

said bearing and power cylinders cooling system comprised of one round cylinder weight bearing ridge on the outer edge of the cylinder next to the heating means;

said weight bearing ridge substantially flat and polished;

said weight bearing ridge functioning to support the weight of said revolving cylinder by means of a plurality of roller bearings which are mounted to the frame of said ironer;

said bearings spaced so as to bear the weight of the revolving cylinder and prevent said cylinder from moving in any direction other than rotationally;

said bearings and power cylinders directly cooled by forced air supplied by means of a tube mounted in close proximity to all said bearings;

said bearings further cooled by the dissipation of said roller surface heat through said weight bearing ridges; and the end of said cylinder opposite said heating means being supported by axle means.

5. A heated revolving ironer and dryer in claim 1 wherein said flexible ironing bed is further comprised of a material with a plurality of holes functioning to allow the release of moisture from the laundry work pieces while the ironing function is performed.

6. A heated revolving ironer and dryer in claim 1 wherein said flexible ironing bed is further comprised of a material impregnated with polytetrafluoroethylene functioning to reduce sliding friction.

7. A heated revolving ironer and dryer in claim 1 wherein said flexible ironing bed is further comprised of a fabric impregnated with graphite functioning to conduct static electricity out of the laundry work pieces.

* * * * *